US010186792B2

(12) United States Patent
Riesgaard et al.

(10) Patent No.: US 10,186,792 B2
(45) Date of Patent: Jan. 22, 2019

(54) WRAPPABLE EXTENSION CORD APPARATUS AND RELATED METHODS

(71) Applicant: QUIRKY IP LICENSING LLC, New York, NY (US)

(72) Inventors: Jacob Niels Riesgaard, Bonaire, GA (US); Jessica Fugler, New York, NY (US); Jordan Diatlo, New York, NY (US); Nicholas Oxley, New York, NY (US); Faris Elmasu, New York, NY (US)

(73) Assignee: QUIRKY IP LICENSING LLC, New York, NY (US)

( * ) Notice: Subject to any disclaimer, the term of this patent is extended or adjusted under 35 U.S.C. 154(b) by 0 days.

(21) Appl. No.: 13/943,409

(22) Filed: Jul. 16, 2013

(65) Prior Publication Data

US 2014/0024247 A1 Jan. 23, 2014

Related U.S. Application Data

(60) Provisional application No. 61/672,859, filed on Jul. 18, 2012.

(51) Int. Cl.
*H01R 11/01* (2006.01)
*H01R 31/06* (2006.01)

(52) U.S. Cl.
CPC ..... *H01R 11/01* (2013.01); *H01R 31/06* (2013.01)

(58) Field of Classification Search
CPC ..... H01R 11/01; H01R 31/06
USPC ..... 439/502
See application file for complete search history.

(56) References Cited

U.S. PATENT DOCUMENTS

| | | | | | |
|---|---|---|---|---|---|
| 4,648,733 | A * | 3/1987 | Merkt | 403/56 | |
| 4,866,583 | A * | 9/1989 | Targetti | 362/404 | |
| 5,008,793 | A * | 4/1991 | Copeland | 362/413 | |
| 5,033,528 | A * | 7/1991 | Volcani | 160/351 | |
| D359,722 | S * | 6/1995 | Owens | D13/137.1 | |
| 5,592,749 | A * | 1/1997 | Trimmer | 34/97 | |
| 5,615,945 | A * | 4/1997 | Tseng | 362/640 | |
| 5,702,176 | A * | 12/1997 | Engle | 362/219 | |
| 5,807,241 | A * | 9/1998 | Heimberger | 600/142 | |
| 6,004,138 | A * | 12/1999 | Harbertson | 439/32 | |
| 6,077,109 | A * | 6/2000 | Prazoff | H01R 13/72 | 191/12.4 |
| 6,299,327 | B1 * | 10/2001 | Camarota | 362/219 | |
| 6,462,132 | B2 * | 10/2002 | Willems | C08L 23/10 | 525/88 |
| 6,479,752 | B1 * | 11/2002 | Neuroth et al. | 174/106 R | |
| D472,520 | S * | 4/2003 | Genicevitch | D13/137.2 | |
| 6,680,844 | B2 * | 1/2004 | Kim | 361/679.02 | |
| 6,875,924 | B2 * | 4/2005 | Porter et al. | 174/69 | |

(Continued)

FOREIGN PATENT DOCUMENTS

RU 63988 U1 6/2007

OTHER PUBLICATIONS

International Search Report dated Oct. 18, 2013, that issued in the corresponding International Application No. PCT/US2013/050742.

*Primary Examiner* — Alexander Gilman
(74) *Attorney, Agent, or Firm* — Myers Wolin, LLC

(57) ABSTRACT

At least one exemplary aspect comprises an apparatus comprising: (a) a plug component at a first end of a cord; (b) an outlet component at a second, opposite end of the cord; and (c) a gooseneck component that encloses at least a portion of the cord.

11 Claims, 15 Drawing Sheets

(56) References Cited

U.S. PATENT DOCUMENTS

| | | | | |
|---|---|---|---|---|
| 7,059,881 | B2 * | 6/2006 | Song et al. | 439/191 |
| 7,220,128 | B1 * | 5/2007 | Hicks | H01R 25/00 439/32 |
| 7,223,122 | B2 * | 5/2007 | Mori | H01R 13/447 439/501 |
| RE39,795 | E * | 8/2007 | Wright | 38/94 |
| 7,526,097 | B2 * | 4/2009 | Akino | 381/361 |
| 7,874,856 | B1 * | 1/2011 | Schriefer et al. | 439/214 |
| 8,033,867 | B1 * | 10/2011 | Kessler et al. | 439/652 |
| 8,133,060 | B2 * | 3/2012 | Wadsworth | 439/21 |
| 8,254,846 | B2 * | 8/2012 | Seil | B60R 11/02 455/345 |
| D666,972 | S * | 9/2012 | Kuo | D13/139.1 |
| 8,295,770 | B2 * | 10/2012 | Seil et al. | 455/41.3 |
| D682,789 | S * | 5/2013 | Au | D13/137.3 |
| 8,520,879 | B2 * | 8/2013 | Yoshino | 381/363 |
| 8,551,115 | B2 * | 10/2013 | Steger et al. | 606/130 |
| 8,662,866 | B2 * | 3/2014 | Huang et al. | 417/363 |
| D705,735 | S * | 5/2014 | Zaslavsky | D13/139.7 |
| D705,737 | S * | 5/2014 | Zaslavsky | D13/139.7 |
| 8,905,780 | B2 * | 12/2014 | Vallon | H01R 13/72 439/501 |
| 9,350,113 | B2 * | 5/2016 | Garner | H01R 13/5841 |
| 2002/0131269 | A1 * | 9/2002 | Bird et al. | 362/198 |
| 2009/0316426 | A1 * | 12/2009 | Gilligan | 362/551 |
| 2010/0078536 | A1 * | 4/2010 | Galvin | 248/231.51 |
| 2010/0128913 | A1 * | 5/2010 | Seil et al. | 381/334 |
| 2011/0177704 | A1 * | 7/2011 | Siu | H01R 25/003 439/136 |
| 2012/0091307 | A1 * | 4/2012 | Haynes | 248/451 |
| 2014/0024247 | A1 * | 1/2014 | Riesgaard et al. | 439/502 |

* cited by examiner

| Qty. | Material | Finish | Estimated Weight (grams) | Component No. | Picture | Number of Cavities | Part Cost | Comments |
|---|---|---|---|---|---|---|---|---|
| 1 | ABS | TBD | 18 | 130 | | 4 + 4 | | 1. To be joined by ultrasonic welding<br>2. There will be pad printing on the "yellow" surfaces of each part |
| 1 | ABS | TBD | 16 | 130 | | | | |
| 1 | Aluminum | | | 150 | | | | Length - 450 mm (18 inches) |
| 1 | PVC / PP | --- | | 160 | | | | Overmolded on the Armature |
| 1 | | | | | | | | 1. Length - 6 feet<br>2. Armature_Sleeve and Armature must be pre-assembled to this part prior to final assembly |
| 1 | Copper | | | 620 | | | | |
| 2 | Copper | | | 620 | | | | |

FIG. 2

| Item No. | Part Description | Qty. | Material | Estimated Weight (grams) | Picture | Comments |
|---|---|---|---|---|---|---|
| 1 | Q349_01_A_HEAD2B_15 | 1 | PC | 29.2 | | Untrasonic welding |
| 2 | Q349_01_A_HEAD2_18 | 1 | PC | 28.5 | | |
| 3 | Q349_01_A_FACE2B_4 | 1 | PC | 7.0 | | |
| 4 | Q349_01_A_FACE1B_7 | 1 | PC | 7.0 | | |
| 5 | Q349_01_A_BOTTOM_8 | 1 | PC | 4.1 | | Untrasonic welding |
| 6 | Q349_01_A_BOTTOM2_2 | 1 | PC | 4.1 | | |
| 7 | Q349_01_A_VERTEBRAE_4 | 31 | POM | 3.3 | | assembled together through force |
| 8 | Q349_01_A_TUBE_11 | 1 | TPE or Rubber | --- | | OEM corrugated tubing, ~440mm long |
| 9 | Q349_01_A_PLUG_1 | 1 | | --- | | UL-certified |
| 10 | GROUND_CONTACT | 1 | Copper | --- | | |
| 11 | L_N_CONTACT_PLATE | 2 | Copper | --- | | |
| 12 | STRAIN RELIEF | 1 | --- | --- | | |

FIG. 15

WRAPPABLE EXTENSION CORD APPARATUS AND RELATED METHODS

CROSS-REFERENCE TO RELATED APPLICATIONS

This application claims priority to U.S. Provisional Patent Application No. 61/672,859, filed Jul. 18, 2012, entitled "Wrappable Extension Cord Apparatus." The entire contents of the above-referenced application are incorporated herein by reference.

INTRODUCTION

An exemplary embodiment comprises a wrappable extension cord apparatus that comprises an extension cord component connected to a plug component at one end and connected to an outlet component at an opposite end. A flexible gooseneck component (i.e., a flexible, jointed pipe) lies between the two ends.

Exemplary methods of use comprise: wrapping around a bed post, in order to provide power for a laptop, clock, or other device; wrapping around the leg of a ladder, to provide power to power tools (without the cords hanging loose); and attaching to a leg of a desk, to preclude the need to reach under the desk to plug into an outlet.

At least one exemplary aspect comprises an apparatus comprising: (a) a plug component at a first end of a cord; (b) an outlet component at a second, opposite end of the cord; and (c) a gooseneck component that encloses at least a portion of the cord.

In various exemplary embodiments: (1) the gooseneck component comprises an aluminum armature component; (2) the aluminum armature component is over molded with a flexible plastic sleeve; (3) the gooseneck component comprises a thermoplastic assembly comprising individual units; (4) the thermoplastic assembly is enclosed in a thermoplastic elastomer tube; (5) the thermoplastic is polycarbonate; (6) the gooseneck component is attached to the outlet component; (7) the outlet component comprises a plurality of outlets; (8) the apparatus further comprises one or more USB ports; (9) at least one outlet in the outlet component accepts a non-U.S. plug; (10) at least one plug in the plug component conforms to a non-U.S. outlet; (11) the apparatus further comprises a surge protector; (12) at least one outlet in the outlet component is a grounded outlet; and (13) at least one outlet in the outlet component is an ungrounded outlet; (14) at least one plug in the plug component is a grounded plug; and/or (15) at least one plug in the plug component is an ungrounded plug.

Other aspects and embodiments, including methods of use and manufacture, will be apparent to those skilled in the art after reviewing the description and drawings provided herein.

BRIEF DESCRIPTION OF THE DRAWINGS

FIG. 2 provides an exemplary component/materials description.

FIG. 15 provides another exemplary component/materials description.

DESCRIPTION OF SELECT EXEMPLARY EMBODIMENTS

Figure 1:
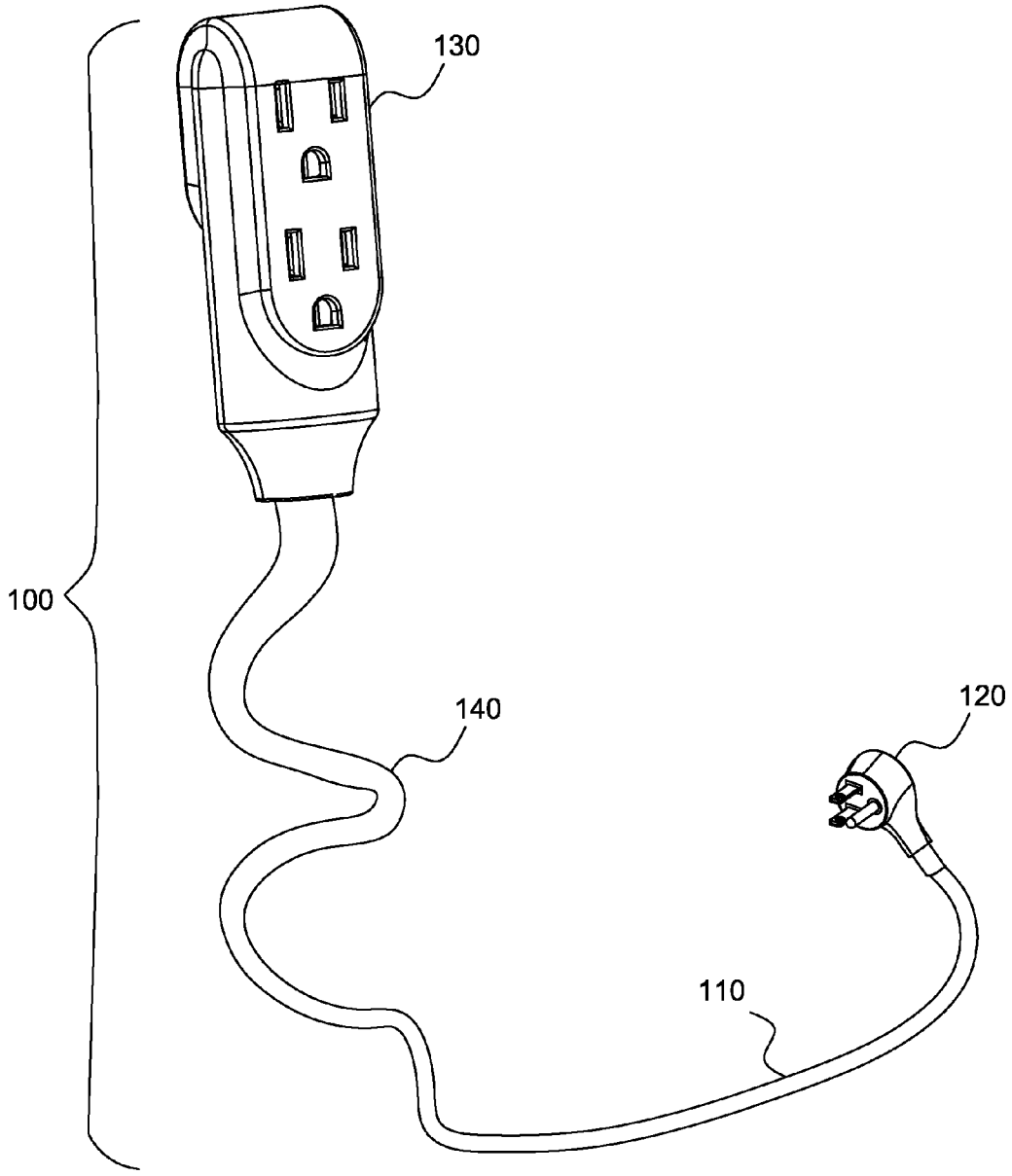
FIG. 1 depicts an exemplary embodiment of a wrappable extension cord apparatus.

FIG. 1 depicts an exemplary embodiment of a wrappable extension cord apparatus. In this embodiment, the apparatus 100 comprises an extension cord component 110 connected to a plug component 120 at one end and connected to an outlet component 130 at an opposite end. A flexible gooseneck component 140 lies between the two ends.

The gooseneck component 140, in an exemplary embodiment, may be, for example, approximately 18 inches long and may comprise an aluminum armature component 150 wrapped around a section of extension cord component 110 and then over molded with a flexible plastic armature sleeve 160. See FIGS. 2 and 6.

In another exemplary embodiment, component 150 is a thermoplastic (polycarbonate) assembly made up individual units acting like the vertebrae of a spine, and component 160 is not overmolded, but instead comprises a corrugated, flexible tube made of thermoplastic elastomer into which the gooseneck assembly is inserted. See FIGS. 9-15.

The gooseneck component allows for positional flexibility, and may be any suitable length. Extension cord component 110 also may be any suitable length; standard lengths are 6, 9, and 12 feet.

Exemplary methods of use comprise: (a) a user wrapping the gooseneck component around a bedpost (for example, to plug in and charge a cellphone); (b) a user working on a ladder and wrapping the gooseneck component around the leg of the ladder so that power tool cords are not dangling; and (c) a user wrapping the gooseneck component around a work desk component (for example, to plug in a monitor), in order to avoid using a power strip located under the desk.

In an exemplary embodiment, the main body of outlet component 130 is made, for example, of polycarbonate (PC) or ABS plastic, and the internal contact points for electricity are made of copper. See FIGS. 2 and 6. However, those skilled in the art will understand that various materials may be used to manufacture the components of extension cord apparatus 100.

Figure 3:
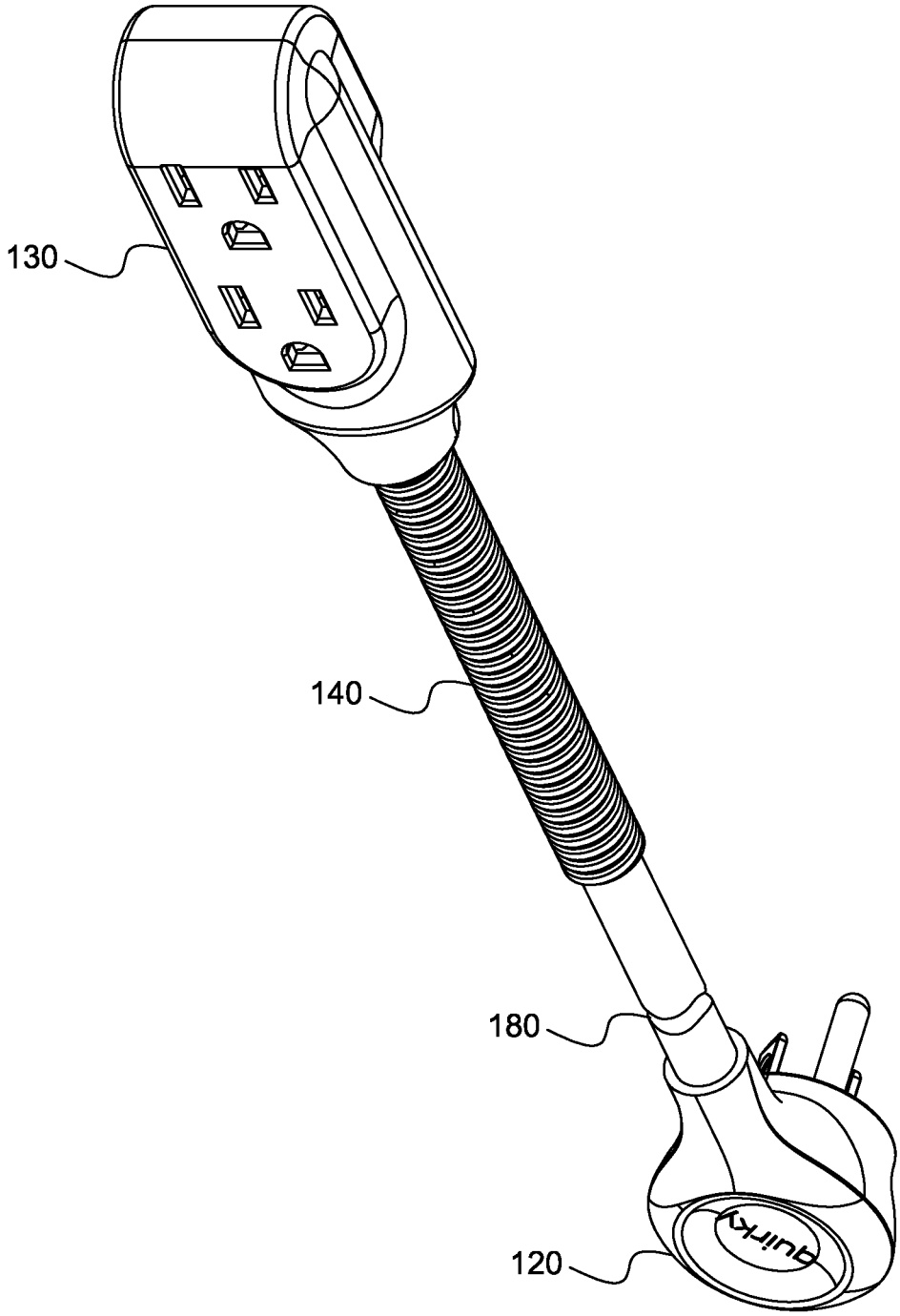
FIGS. 3-5 depict perspective views of an exemplary embodiment of extension cord apparatus 100.
Figure 4:
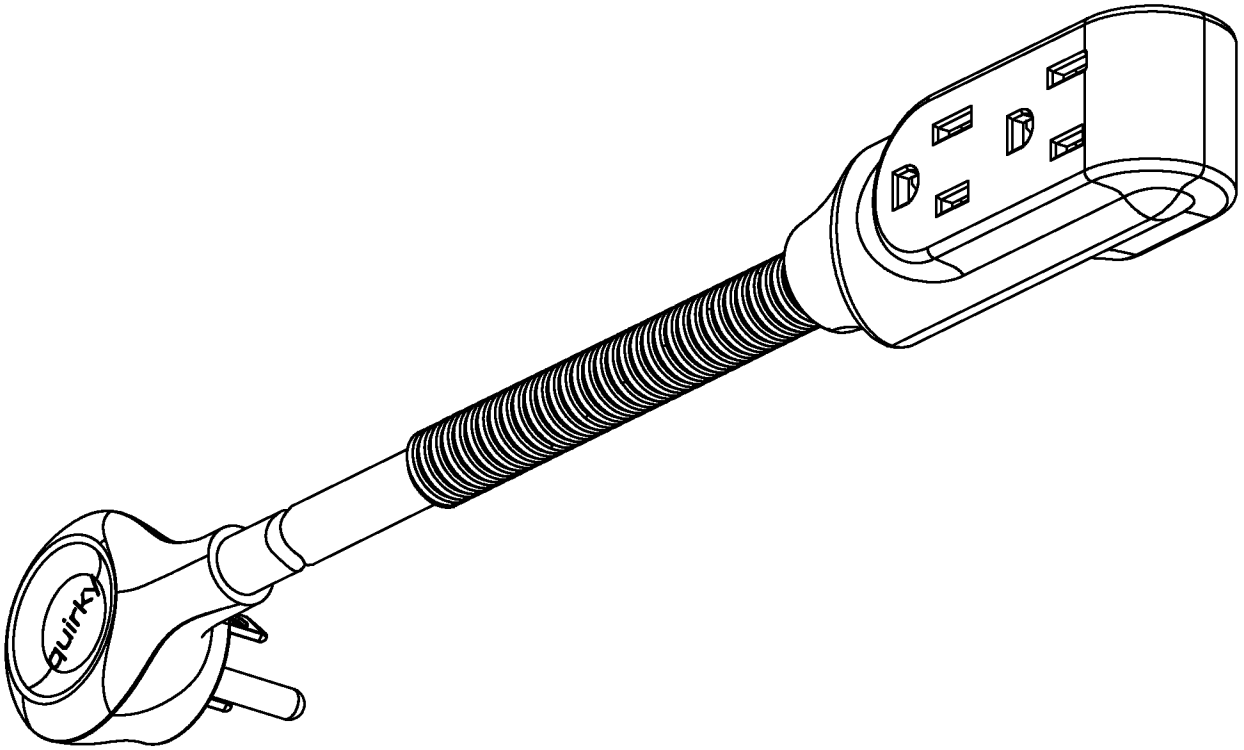
Figure 5:
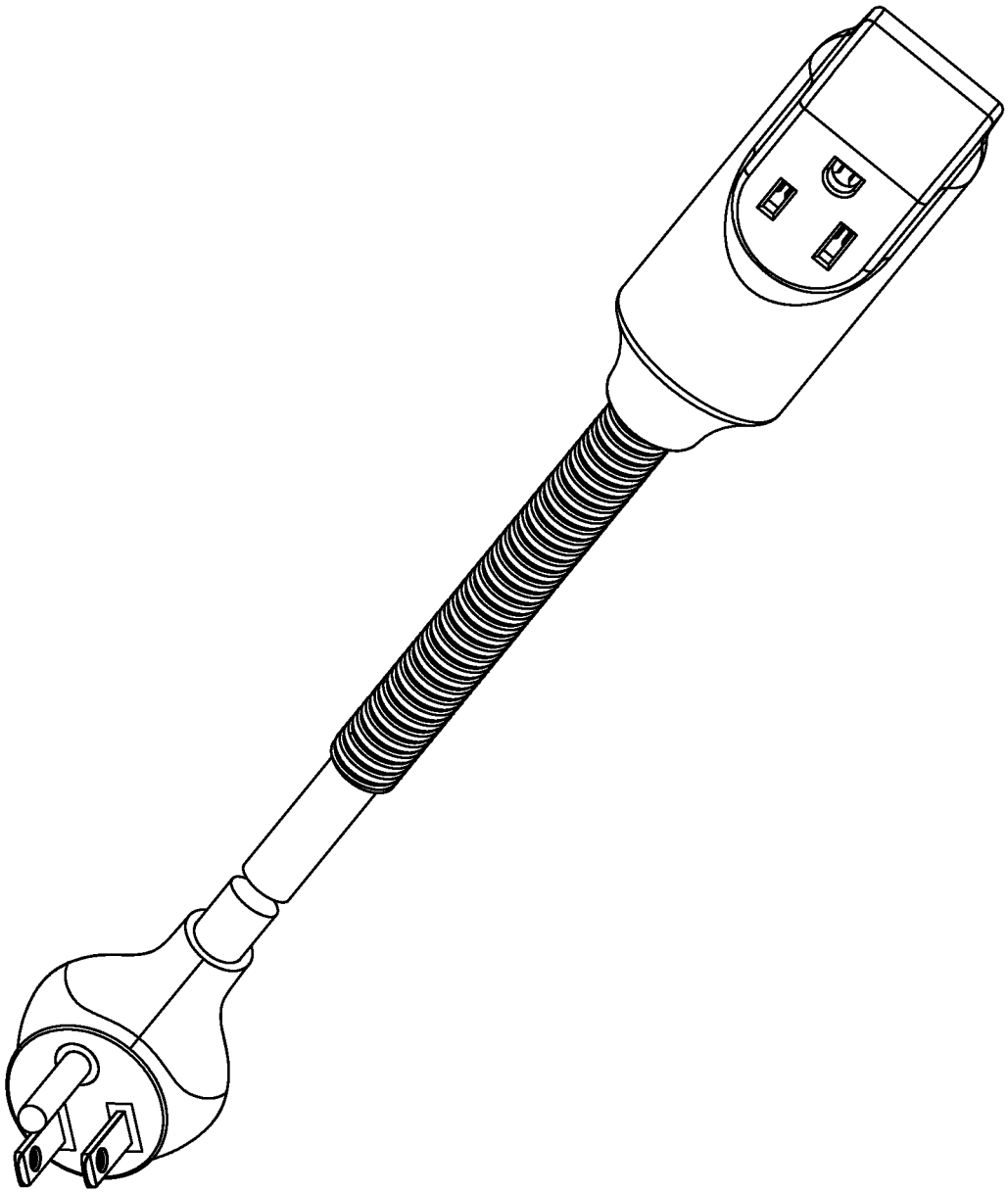
Figure 6:
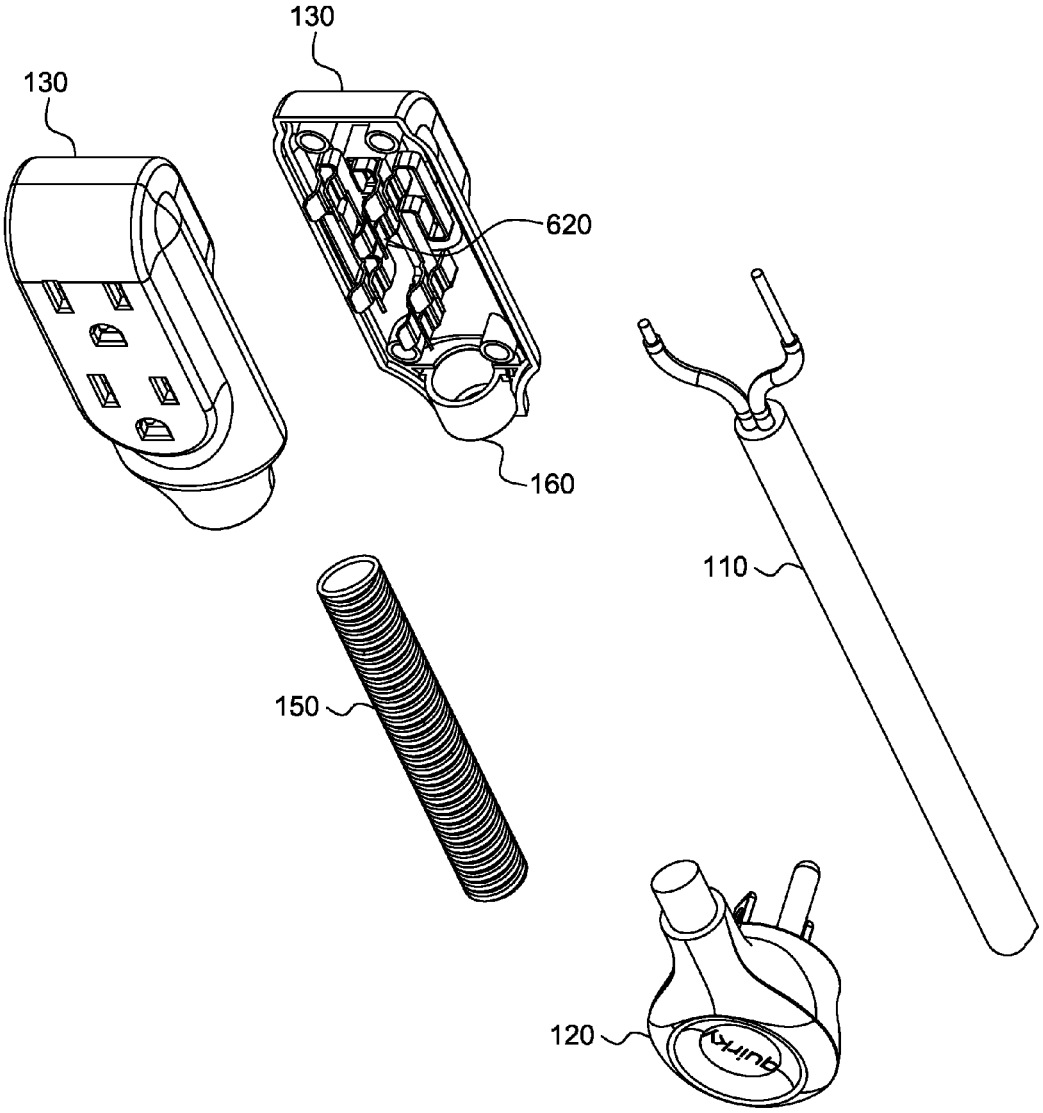
FIGS. 6-8 depict perspective views of components forming an exemplary embodiment of apparatus 100.
Figure 7:
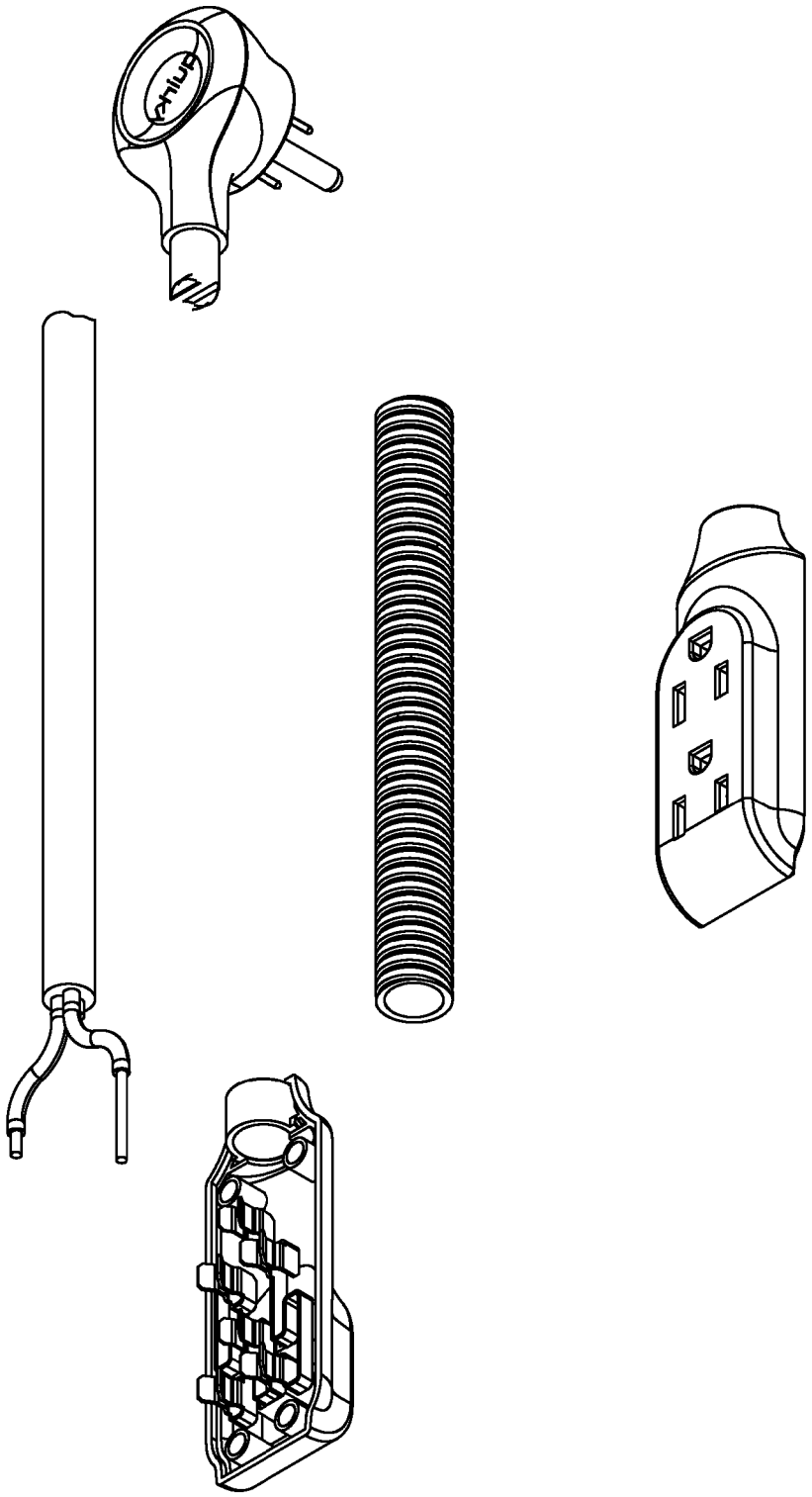
Figure 8:
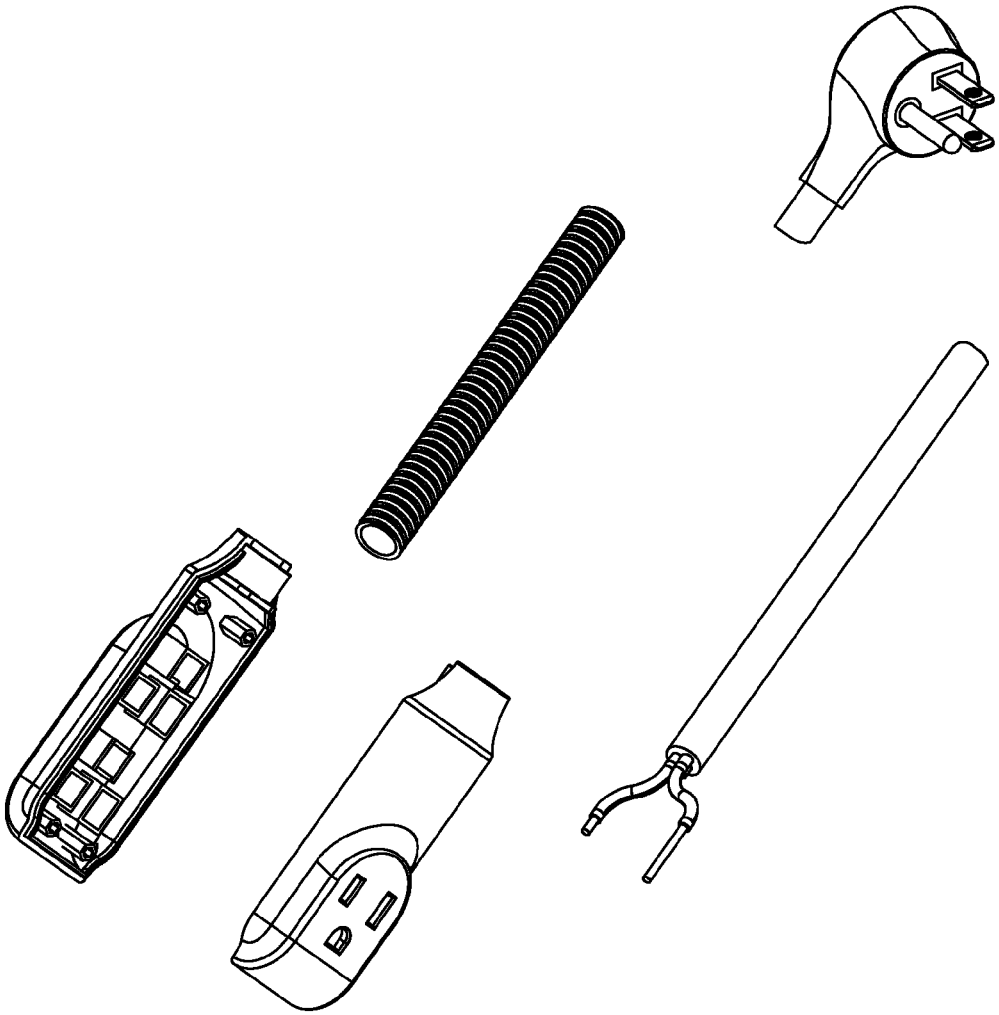
Figure 9:
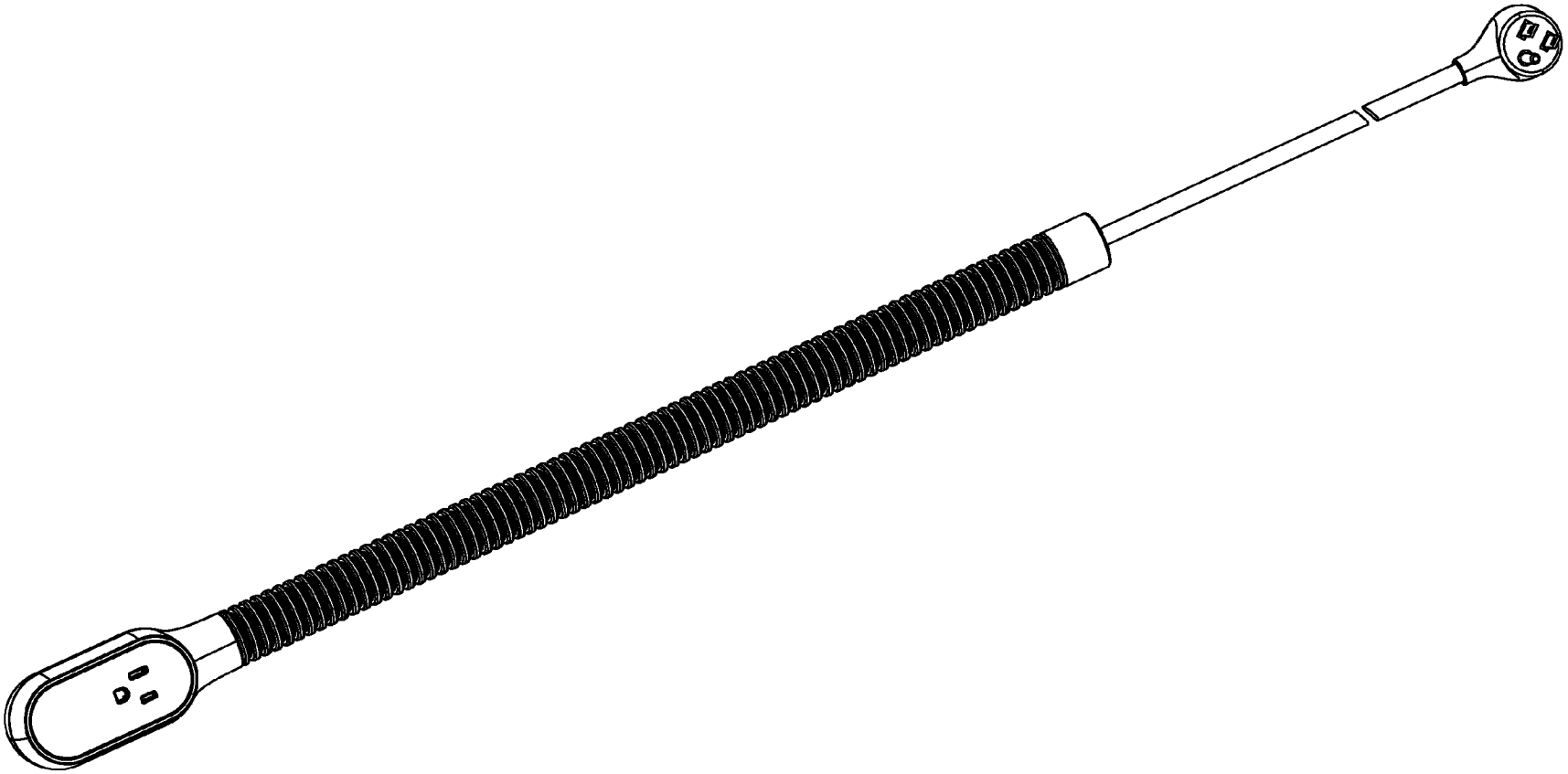
FIGS. 9-14 depict perspective views of an exemplary embodiment of extension cord apparatus 100.
Figure 10:
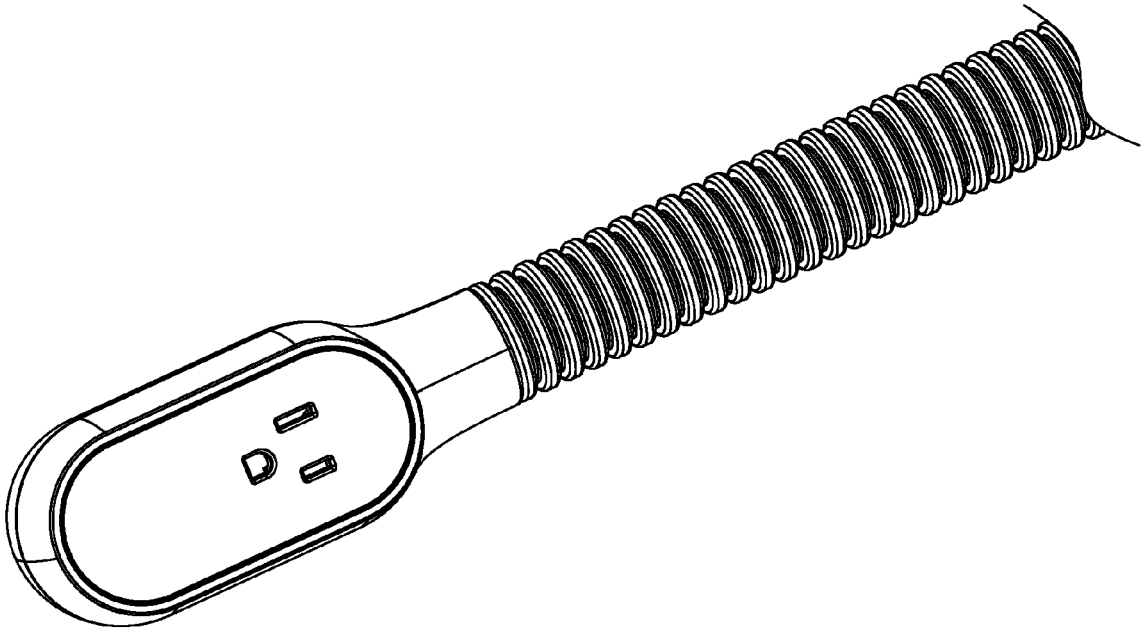
Figure 11:
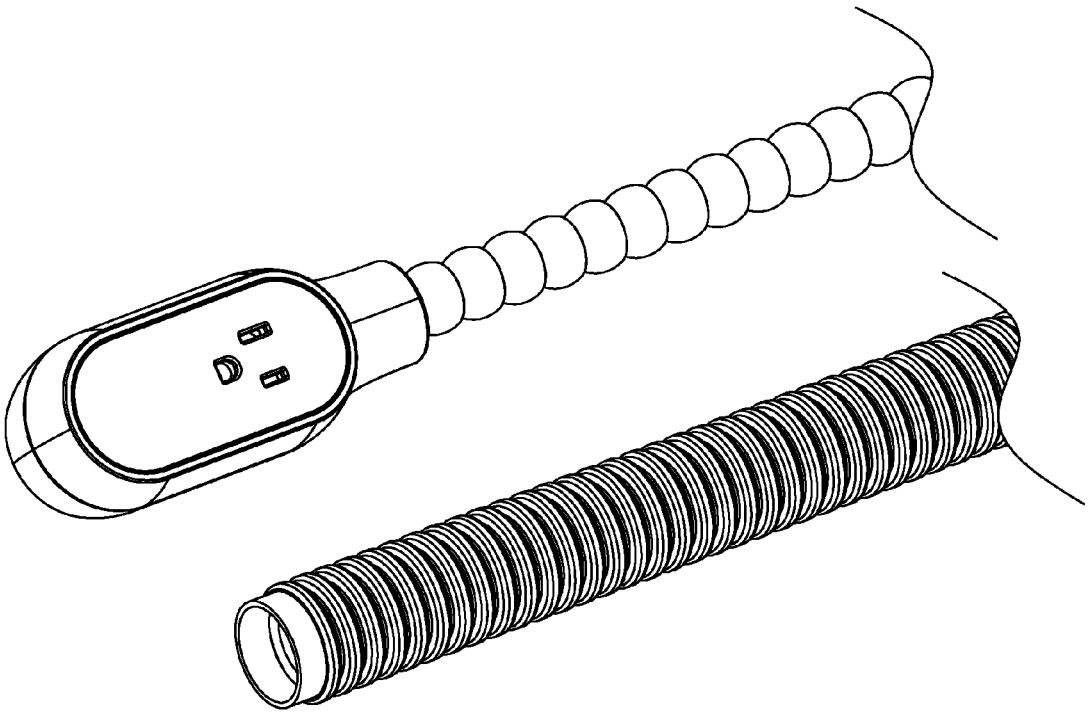
Figure 12:
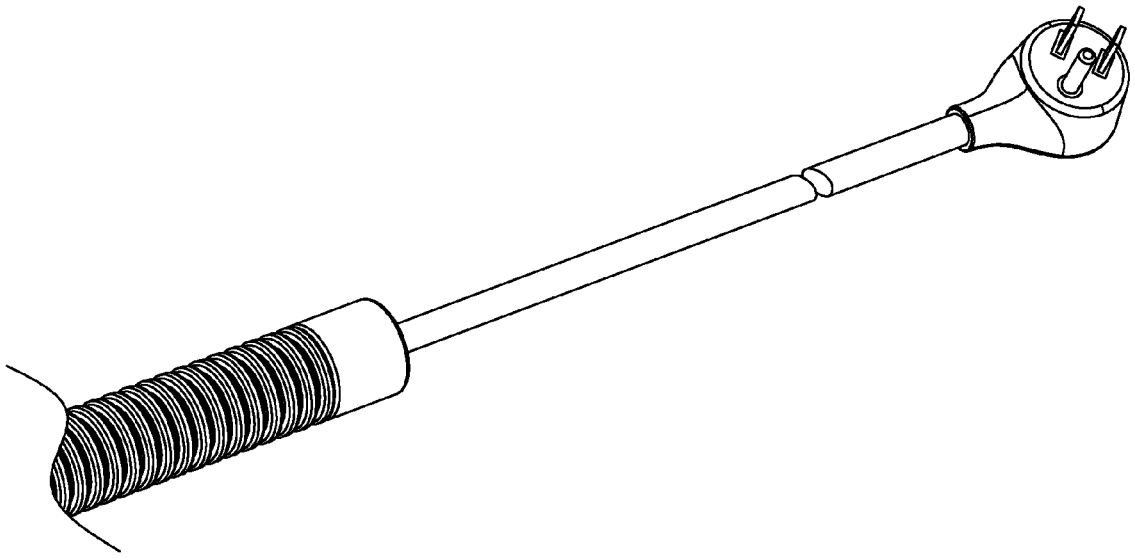
Figure 13:
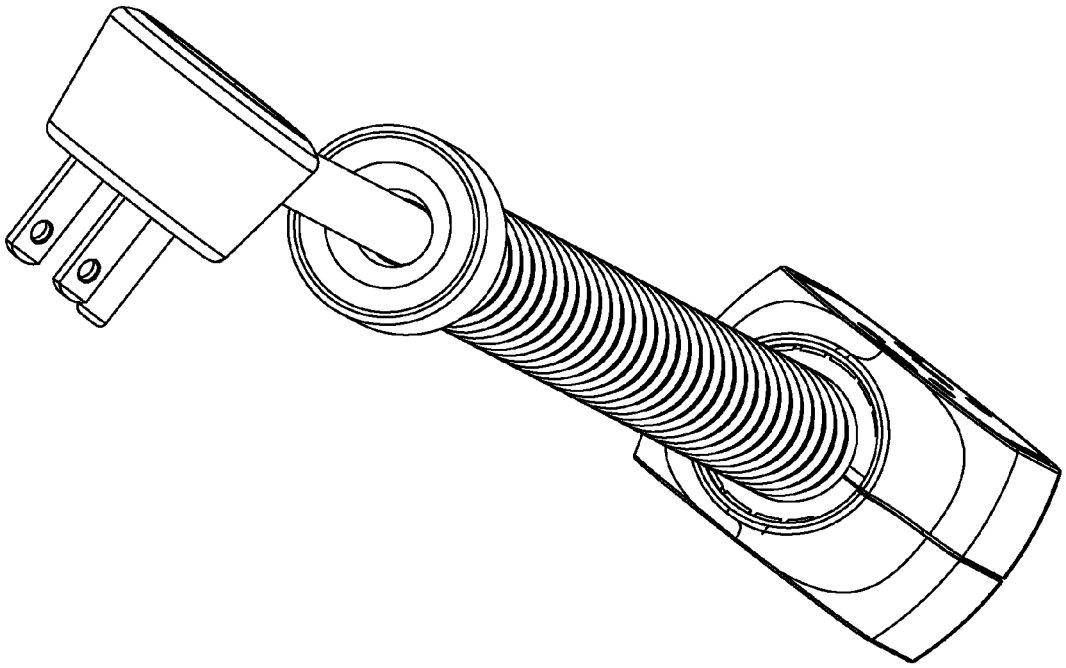
Figure 14:
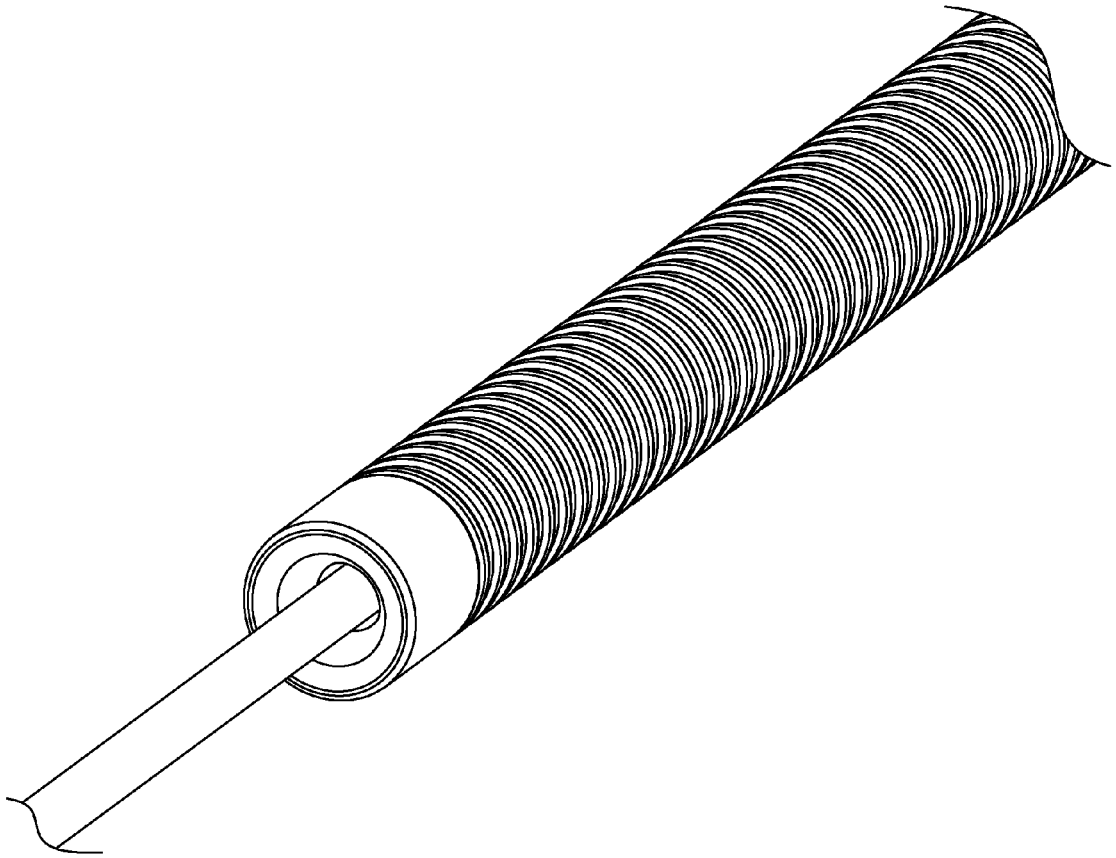

FIGS. 3-5 depict perspective views of extension cord apparatus 100, while FIGS. 6-8 depict perspective views of components forming apparatus 100.

In FIGS. 3-5, extension cord apparatus 100 is shown in an "unwrapped" configuration, wherein gooseneck component 140 is essentially straight. Moreover, much of extension cord component 110 is not shown, and is represented by the gap 180 between plug component 120 and gooseneck component 140.

FIGS. 6-8 depict apparatus 100 in exploded views, showing various components separately. As shown, armature 150 may be attached to outlet component 130 via armature sleeve 160. Outlet component 130 may comprise internal contact points 620, which may be made of copper (see FIG. 2).

FIGS. 9-14 depict perspective views of an exemplary embodiment of extension cord apparatus 100. FIG. 15 provides an exemplary component/materials description for that embodiment.

While certain exemplary aspects and embodiments have been described herein, many alternatives, modifications, and variations will be apparent to those skilled in the art. For example, in one or more exemplary embodiments: (a) the outlet component may comprise multiple outlets, for example on each side, and may have more than two sides; (b) the apparatus (e.g., the outlet component) may comprise one or more USB ports; (c) the apparatus may comprise one or more surge protectors; and (d) the outlets and plugs may conform to various non-U.S. and international standards (e.g., BS 546, CEE 7, etc.), and be grounded or ungrounded, polarized or not polarized.

Accordingly, exemplary aspects and embodiments set forth herein are intended to be illustrative, not limiting. Various modifications may be made without departing from the spirit and scope of the disclosure.

We claim:

1. An apparatus comprising:

a male electrical plug component at a first end of a cord, the cord having a first length;

a female electrical outlet component at a second, opposite end of the cord; and a positionally flexible gooseneck component that encloses a portion of the cord, wherein the positionally flexible gooseneck component comprises an aluminum armature component over molded with a flexible plastic sleeve, the positionally flexible gooseneck component having a second length shorter than the first length, wherein the positionally flexible gooseneck component is attached to the female electrical outlet component, and wherein the cord extends from an end of the positionally flexible gooseneck component to connect to the male electrical plug component.

2. The apparatus of claim 1, wherein the female electrical outlet component comprises a plurality of outlets.

3. The apparatus of claim 1, further comprising one or more USB ports.

4. The apparatus of claim 1, wherein at least one outlet in the female electrical outlet component is a grounded outlet.

5. The apparatus of claim 1, wherein at least one outlet in the female electrical outlet component is an ungrounded outlet.

6. The apparatus of claim 1, wherein at least one plug in the male electrical plug component is a grounded plug.

7. The apparatus of claim 1, wherein at least one plug in the male electrical plug component is an ungrounded plug.

8. The apparatus of claim 1, wherein the female electrical outlet component comprises a single female electrical outlet component and wherein no additional female electrical outlet components are placed between the male electrical plug component and the single female electrical outlet component.

9. The apparatus of claim 1, wherein the component of the object external to the apparatus comprises one of a bedpost, a leg of a ladder, or a work desk component.

10. The apparatus of claim 1, wherein the positionally flexible gooseneck component is wrappable around a component of an object external to the apparatus such that the female electrical outlet component is retained and positioned by the positionally flexible gooseneck component relative to the object.

11. An apparatus comprising:

a male electrical plug component at a first end of a cord, the cord having a first length;

a female electrical outlet component at a second, opposite end of the cord; and a positionally flexible gooseneck component that encloses a portion of the cord, wherein the positionally flexible gooseneck component comprises a polycarbonate assembly comprising individual units and polycarbonate assembly is enclosed in a thermoplastic elastomer tube, the positionally flexible gooseneck component having a second length shorter than the first length, wherein the positionally flexible gooseneck component is attached to the female electrical outlet component, and wherein the cord extends from an end of the positionally flexible gooseneck component to connect to the male electrical plug component.

* * * * *